United States Patent [19]

Jeffers

[11] Patent Number: 4,909,386

[45] Date of Patent: Mar. 20, 1990

[54] STORAGE RECEPTACLES FOR DRILL BITS

[75] Inventor: William P. Jeffers, County Down, Northern Ireland

[73] Assignee: Visual Inspection Automation Limited, Dunmurry, United Kingdom

[21] Appl. No.: 311,246

[22] Filed: Feb. 16, 1989

[30] Foreign Application Priority Data

Feb. 17, 1988 [GB] United Kingdom ..... 8803587

[51] Int. Cl.[4] ..... B65D 85/28

[52] U.S. Cl. ..... 206/379; 206/380; 206/485; 211/69

[58] Field of Search ..... 206/378, 379, 380, 381, 206/461, 486, 490, 471, 485; 211/69

[56] References Cited

U.S. PATENT DOCUMENTS

| | | | |
|---|---|---|---|
| 2,844,244 | 7/1958 | Hanson | 206/379 |
| 3,367,483 | 2/1968 | Studen | 211/69 |
| 3,426,890 | 2/1969 | Bayer | 206/379 |
| 4,324,331 | 4/1982 | Ignasiak | 206/461 |
| 4,413,731 | 11/1983 | Weidemann | 206/379 |
| 4,598,822 | 7/1986 | Hemmings | 206/379 |

FOREIGN PATENT DOCUMENTS

| | | | |
|---|---|---|---|
| 1222240 | 6/1960 | France | 206/379 |

*Primary Examiner*—David T. Fidei

*Attorney, Agent, or Firm*—Armstrong, Nikaido, Marmelstein, Kubovcik & Murray

[57] ABSTRACT

A storage receptacle for drill bits having collars thereon, comprises an elongate tubular body having a longitudinal passage therein. The body has at least one end open through which drill bits can pass into the passage. The open end is provided with a closure device. The body has internally on each side defining the sides of the passage an inwardly-directed channel longitudinally thereof. The channels are mutually opposed and are adapted to receive and hold collars of the drill bits from axial movement while permitting movement along the passage with at least the point and cutting edges of the drill bits held spaced from the internal sides of the body.

7 Claims, 2 Drawing Sheets

STORAGE RECEPTACLES FOR DRILL BITS

BACKGROUND OF THE INVENTION

This invention relates to storage receptacles or magazines for drill bits. The drill bits are primarily, but not exclusively, of small diameter and are particularly, but not exclusively, for use in drilling printed circuit boards (PCBs) where the diameter of the holes required is very fine, sometimes in the order of 2 to 4 mm in diameter and therefore the bits required for this function are very fine and fragile and easily damaged when being handled and also through use.

There are several disadvantages present in the handling of such drill bits either after initial manufacture or after regrinding. After manufacture, the drill bits are each provided with a tight fitting collar of eg. a plastics material, the collar being positioned at a pre-determined distance from the point of the drill. In the re-grinding process, the distance between the collar and the point is checked. After manufacture of re-grinding, the drill bits are normally placed in a box having a hinged lid. While there are holes in an insert in the box into which the stem of the bits are placed to hold the bits upright and the insert and lid have foamed material for the protection of the drill bits, due to their fragility, damage can be caused when closing the lid if care is not taken.

Heretofore, holes in PCBs are drilled in a group in a pre-set pattern when the chuck of a drill with a plurality of drill bits moves down towards the PCB. All bits should come into contact with the PCB simultaneously. Obviously, if one or more of the plurality of bits is out of position due to incorrect fitting into the chuck, damage prior to use, or due to damage through wear, then this could possibly cause damage to the PCBs through incorrect drilling of holes into the PCBs. Due to the bits being very fine, any damage to the bits cannot be seen unless each bit is magnified and examined. This is disadvantageous since it is labour intensive and therefore costly to have to examine the bits. It is also costly to continually having to take the drill out of service to inspect the bits, apart from having to reject PCBs which are incorrectly drilled due to the initial damage of the bits.

SUMMARY OF THE INVENTION

It is an object of the present invention to obviate or mitigate these disadvantages.

Accordingly, the present invention is a storage receptacle for drill bits having collars thereon, comprising an elongate tubular body having a longitudinal passage therein with at least one end open through which drill bits can pass into the passage, the body having internally on each side defining the sides of the passage an inwardly-directed channel longitudinally thereof, the channels being mutually opposed and in and between which collars of the drill bits can track and be held axially fast with at least the point and cutting edges of the drill bits held spaced from the internal sides of the body.

Preferably, an enlargement is provided in the passage at the location where the point of a drill bit is positioned when loaded into the passage.

Preferably also, the body is fabricated from two complimentary parts secured together by one or more fastenings.

Alternatively, the body is formed in one piece from extruded plastics material.

Preferably further, both ends are open and are each provided with a closure means.

BRIEF DESCRIPTION OF THE DRAWINGS

Embodiments of the present invention will be now be described, by way of example, with reference to the accompanying drawings, in which.

DETAILED DESCRIPTION OF PREFERRED EMBODIMENTS

Figure 1:
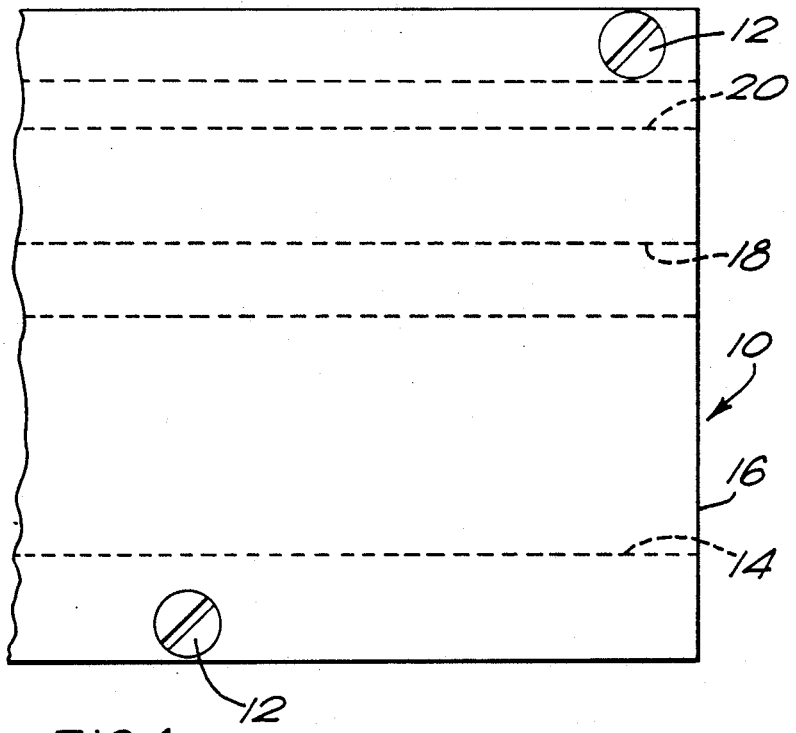
FIG. 1 is a side view of one end of a receptacle according to a first embodiment of the present invention.

Referring to the drawings for both embodiments, a storage receptacle or magazine for drill bits 6 having collars 8 tight fitted thereon, comprises a straight elongate tubular body 10 having a longitudinal passage which is open at both ends through which drill bits can pass into or from the passage 14. Each end 16 is provided with a closure means in the form of a rubber stopper or bung 22. The body 10 has internally on each side defining the sides of the passage 14 an inwardly-directed channel 18 longitudinally thereof. The channels 18 are mutually opposed as shown, and in and between which collars 8 of the drill bits 6 can track and be held axially fast with at least the point and cutting edges of the drill bits 6 held spaced from the internal sides of the body 10. One rubber stopper 22 is engagable in and between the channels 18 at each end. An enlargement 20 is provided in the passage 14 as shown at the location where the point of each drill bit 6 is positioned when loaded into the passage 14.

Figure 2:
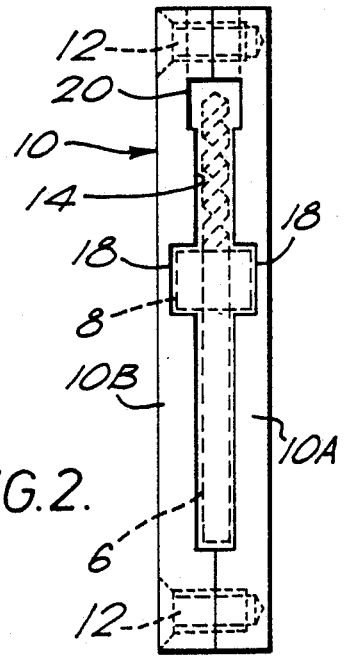
FIG. 2 is an end view of the receptacle shown in FIG. 1 with a drill bit located therein.

In the first embodiment as shown in FIGS. 1 and 2, the body 10 is fabricated from two complimentary parts 10A, 10B secured together by screw fastenings 12.

Figure 5:
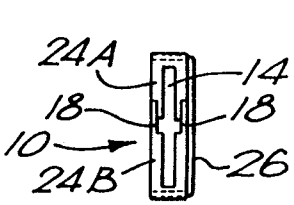
FIG. 5 is an end view of the receptacle shown in FIG. 4.
Figure 3B:
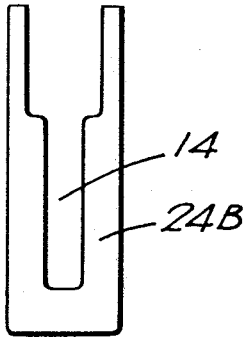
FIGS. 3A and 3B are end views of respectively top and bottom parts of a receptacle according to a second embodiment.
Figure 3A:
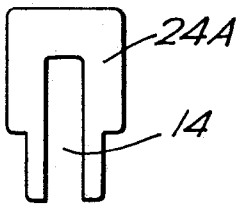
Figure 4:
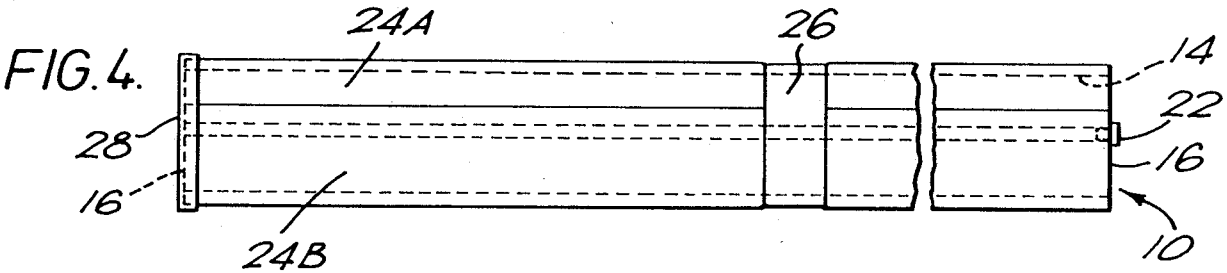
FIG. 4 is a side view of the receptacle formed by the assembly of the parts shown in FIGS. 3A and 3B, to a smaller scale.

In a second embodiment as shown in FIGS. 3A to 5, the body 10 has top and bottom parts 24A and 24B as shown. The top part 24A seats into the bottom part 24B and so forms the opposed channels 18 as shown in FIG. 5. One or more C-clip fastenings 26 are provided to hold the parts 24A and 24B together as shown in FIG. 4.

In use in both embodiments, the storage receptacle has one end open, the other end being closed with a stopper 22, and is filled with drill bits as hereinbefore described with the collars 8 abutting. The bits 6 are fed in at the open end, one at a time, with the collar 8 of each bit 6 tracking the channels 18 and sliding to the other end or to abut the collar 8 of the preceding bit 6. When full, the open end is closed with a stopper 22, and a fresh receptacle is filled.

The body 10 may alternatively be formed in one piece from extruded plastics material. The body may be longitudinally curved rather than straight.

A storage receptacle of the present invention is primarily, but not necessarily, for use in receiving newly manufactured or reground drill bits direct from the manufacturing or regrinding apparatus. The receptacles can then be stored with the bits therein and when required, a magazine can be fitted to an apparatus for placement ready to be inserted into a chuck. The use of the receptacles therefore mitigates the requirement of man-handling of the bits 6 required heretofore.

In a first modificaton, the closure means may be end caps 28 securable to an end of the body.

In a second modification, the body 10 is provided with only one end open.

Other modifications and variations can be made without departing from the scope of the invention described above.

I claim:

1. A storage receptacle for a plurality of drill bits with each drill bit having a point and cutting edge at one end and a collar thereon, comprising: an elongate tubular body, a longitudinal passage defined by spaced side walls internally of said body, said body having at least one end open through which drill bits can be passed into the passage, an inwardly-directed channel formed in each side wall defining said passage and extending longitudinally of said body each channel being opposed to the other channel and adapted to receive and hold the collars of the drill bits against axial movement while permitting movement along said passage with at least the point and cutting edges of the drill bits held spaced from the internal side walls of said body.

2. A storage receptacle according to claim 1, wherein said longitudinal passage is enlarged at the location where the point of a drill bit is positioned when being loaded into the passage.

3. A storage receptacle according to claim 1 or 2, wherein said elongate body is fabricated from two complimentary parts secured together by one or more fastenings.

4. A storage receptacle according to claim 1 or 2, wherein said body is formed in one piece from an extruded plastics material.

5. A storage receptacle according to claim 1 or 2, wherein both ends of said longitudinal passage are open and each end is provided with a closure means.

6. A storage receptacle according to claim 5, wherein the closure means is a stopper engagable in and between the channels.

7. A storage receptacle according to claim 5, wherein the closure means is an end cap engageable with an end of the body.

* * * * *